US005613804A

United States Patent [19]

Beamer

[11] Patent Number: 5,613,804

[45] Date of Patent: Mar. 25, 1997

[54] HOLDING MEANS FOR SECURING A LINER TO A TRENCH

[75] Inventor: John V. Beamer, Atlanta, Ga.

[73] Assignee: Hoosier Group, L.L.C., Atlanta, Ga.

[21] Appl. No.: 404,586

[22] Filed: Mar. 15, 1995

Related U.S. Application Data

[63] Continuation-in-part of Ser. No. 349,901, Dec. 6, 1994.

[51] Int. Cl.[6] ..... E02B 5/00

[52] U.S. Cl. ..... 405/119; 404/4; 405/118

[58] Field of Search ..... 405/118–121; 404/2, 4; 249/9–13

[56] References Cited

U.S. PATENT DOCUMENTS

| | | | |
|---|---|---|---|
| 4,940,359 | 7/1990 | Van Duyn et al. | 404/2 X |
| 5,066,165 | 11/1991 | Wofford et al. | 405/119 |
| 5,181,793 | 1/1993 | DeKel | 404/4 |
| 5,213,438 | 5/1993 | Barenwald | 405/118 X |
| 5,256,000 | 10/1993 | Beamer | 405/119 |

*Primary Examiner*—Dennis L. Taylor
*Attorney, Agent, or Firm*—Needle & Rosenberg, P.C.

[57] ABSTRACT

A trench liner system used for forming a dual containment trench and for relining an existing trench has a primary liner and a secondary liner means extending along the length of the trench, a separating means is disposed between the primary liner and the secondary liner. A means for holding the primary liner, the secondary liner and the separating means against the trench walls has a vertical member having an upper end and an opposite lower end, with a first horizontal member extending from the upper end and terminating in a first edge. A first wall depends from the first edge and a second horizontal member extends from the lower end away from the first horizontal member. The second horizontal member terminates in a second edge having a second wall depending therefrom. The outer surface of the vertical member and the upper surface of the second horizontal member form a ledge adapted to receive grates and covers. In an alternative embodiment, the holding means has a horizontal member having a first end and a second end and a wall depending from the second end. The trench wall defines an opening therein to receive a portion of the horizontal member, with the depending wall overlying the upper portion of the primary liner means.

8 Claims, 8 Drawing Sheets

HOLDING MEANS FOR SECURING A LINER TO A TRENCH

CROSS-REFERENCE TO RELATED APPLICATION

This is a continuation-in-part of my copending application Ser. No. 08/349,901, filed Dec. 6, 1994.

BACKGROUND OF THE INVENTION

1. Field of the Invention

The present invention relates to the construction industry and, more specifically, to the formation of a trench lining system which can renew a system that is wearing or worn out, that can turn an in-place trench into a dual containment trench system, that may be used in new construction to form a trench resistant to a wide variety of chemicals as either single or dual containment at a much lower cost than prior systems and a means for holding a liner incorporated in a trench lining system against a trench wall.

2. Description of the Prior Art

The general concept of trench drainage has long been used. Trenches are used where liquid run-offs occur, such as chemical plants, food processing operations, pulp and paper mills, pharmaceutical manufacturing, bottling plants, in parking garages and parking areas of shopping centers. The fluid from a trench generally goes into a catch basin or sewer large enough to release the material from the trench as it arrives. The top of the trench is normally covered with a slotted grate to allow entrance of the fluids, catching of debris, load carrying capacity for whatever may pass over it and, in some applications, they are solidly covered, such as crossing sidewalks or where conduits are carried within the trench and fluid entry is minimal and not necessarily desirable.

In the prior art, worn out trenches had to be completely removed by cutting the surrounding concrete, removing all brick linings when present, removing the frames and effectively then starting over again to build a new trench. In the prior art, there was no way to convert an existing trench into a dual containment trench, or to build a trench by conventional ways and at the same time turn it into a dual containment trench.

Thus, there exists a world-wide need for an economical method to renew a trench.

There also exists a need for an economical way to construct a dual containment trench.

There also exists a need for a system to renew a trench without replacing it in its entirety.

There also exists a need for a system to convert an existing trench from a single containment to a dual containment system.

There also exists a need to provide a means to build a trench by conventional means and at the same time additionally turn it into a dual containment system.

There also exists a need for a system which can be rapidly installed decreasing plant down time.

SUMMARY OF THE INVENTION

The disadvantages of the prior art are overcome by the present invention, which relates to a grate or solid covered trench to be replaced or constructed by conventional means.

The present invention is a trench liner system for forming a dual containment trench and for relining an existing trench having at least two walls, a bottom surface, a top surface and a bearing surface. It comprises a secondary liner means, with an interior surface and an exterior surface, extending along the length of the trench; a primary liner means, having in interior surface and an exterior surface, disposed within the trench within the secondary liner means and extending along the length of the trench; and a means disposed between the secondary liner means and the primary liner means for separating the interior surface of the secondary liner means from the exterior surface of the primary liner means. It also has means for holding the primary liner means and the separating means and the secondary means against the trench walls.

The separating means comprises a plurality of pairs of elongated members, each member having a first surface and an opposite second surface, an upper edge and a lower edge. The members are disposed along the trench such that the second surface of each elongated member is in contact with the interior surface of the secondary liner means and such that the lower edges of each of the pairs of elongated members are in opposed relationship. Each pair is juxtaposed to a corresponding member of an adjacent pair of elongated members.

The separating means also comprises a plurality of ribs spaced along, and extending above, the first surface of the separating means so that the exterior surface of the primary liner means is supported on the ribs on the first surface of the separating means. This defines a cavity between the exterior surface of the primary liner means and the first surface of the separating means and between the ribs. The plurality of ribs may also extend below the second surface of the separating means so that the fibs on the second surface of the separating means are supported on the interior surface of the secondary liner means. This defines a cavity between the interior surface of the secondary liner means and the second surface of the separating means and between the ribs. The separating means may employ both embodiments of the ribs, alternating between ribs extending above and ribs extending below the separating means.

In an alternative preferred embodiment, the primary liner means comprises a plurality of ribs spaced along the exterior surface of the primary liner means, so that a cavity is formed between the exterior surface of the primary liner means and the first surface of the separating means between the ribs. The ribs may be positioned longitudinally along the exterior surface of the primary liner means and wherein the ribs have a plurality of openings therethrough to allow for the downward flow of fluid into the cavity.

In another alternative preferred embodiment, the secondary liner means comprises a plurality of fibs spaced along the interior surface of the secondary liner means, so that a cavity is formed between the exterior surface of the primary liner means and the second surface of the separating means between the ribs. In this embodiment, the ribs may also be positioned longitudinally along the interior surface of the secondary liner means and wherein the fibs have a plurality of openings therethrough to allow for the downward flow of fluid into the cavity.

The separating means may further comprise a plate, with an upper surface and a lower surface, in contacting relationship with the lower edges of the opposed elongate members to support the primary liner means. The distal edges of the lower portions of the separating means, the plate and the interior surface of the secondary liner means define a gap.

The plate has a plurality of holes passing therethrough from the upper surface through the lower surface so that the gap is capable of being in fluid communication with the upper surface of the plate. A means for detecting fluid flowing into the gap (such as an electronic fluid sensor) through the holes may be placed in the gap or in low points of the trench. Alternatively, a visual detection tank, into which fluid from the gap is capable of draining, may be used to detect fluid flowing in the gap.

When the shape of the secondary liner means does not conform exactly to the shape of the existing trench, a means for supporting the secondary liner means may be disposed within the trench along at least a portion of the length of the trench. The supporting means has a surface complimentary in shape to at least a portion of the exterior surface of the secondary liner. The supporting means comprise a plurality of pairs of elongated members, each member comprising an upright portion having a front surface and an opposite rear surface and a lower end, and a lower portion having an underside surface and horizontally extending from the lower end and terminating in a distal edge. The members are disposed along the trench such that the rear surface of each elongated member is in contact with one wall of the trench and the underside surface of each member is in contact with the bottom of the trench, and such that the distal edges of each of the pairs of elongated members are in opposed relationship.

In order to hold the primary and secondary liner upright, the interior surface of the primary liner has an upper portion and the holding means comprises an anchor member affixed to the existing trench wall adjacent the upper portion thereof. A frame removably attached to the anchor member and overlying the upper portion of the liner and the anchor member holds the primary liner and a means for attaching the frame to the anchor member secures the frame. The anchor member has a planar portion and leg members depending from the planar portion and engaging the top of the wall of the existing trench and wherein the frame comprises a Z-shaped member having a horizontal section with first and second opposed sides. The first side terminates in a depending portion and the second side terminates in an upright portion with the horizontal section overlying the planar portion of the anchor member and the depending portion overlying the upper portion of the liner.

Another frame design, essentially the same as disclosed in U.S. Pat. Nos. 4,993,877; 4,993,878; 5,000,621; 5,256,000; and 5,281,052, may be used. In this embodiment, each of the frames may include an adjustable anchoring means to position the frame to the proper elevation before pouting concrete or other materials. A piece of hanger material, such as a wooden 4×4, or a steel channel may be placed across the trench at various points along the trench. The frames are suspended from the hangar material using wire or nuts and bolts or other devices to hold the frames at the proper finished elevation.

In an alternative preferred embodiment, the holding means is substantially U-shaped and comprises a horizontal member having a first end with a first wall depending therefrom and an opposed second end with a second wall depending therefrom. In this embodiment, the top surface of the trench wall has an opening therein to receive a portion of the first depending wall and the second depending wall overlies the upper portion of the primary liner means.

In another alternative preferred embodiment, the holding means comprises a vertical member having an upper end and an opposite lower end, with a first horizontal member extending from the upper end and terminating in a first edge. A first wall depends from the first edge and a second horizontal member extends from the lower end away from the first horizontal member. The second horizontal member terminates in a second edge having a second wall depending therefrom. The top surface of the trench wall may have an opening therein to receive a portion of the first depending wall, the second depending wall overlying the upper portion of the primary liner means. The vertical member has an inner surface and an opposite outer surface, the second horizontal member has a lower surface and an opposite upper surface. In this embodiment, the outer surface of the vertical member and the upper surface of the second horizontal member form a ledge adapted to receive grates and covers.

The holding means may be secured to the existing trench wall by employing one of several methods. The second horizontal member may define a first opening passing therethrough and a portion of the bearing surface defining a second opening adapted to receive a bolt passing through the first opening, thereby securing the holding means to the trench wall. In employing another method of securing the holding means, the second wall defines a first opening passing therethrough and a portion of the trench wall defines a second opening adapted to receive a bolt passing through the first opening, thereby securing the holding means to the trench wall. Cement, or other sealants, may also be used to secure the holding means to the existing trench wall.

In yet another preferred embodiment, the holding means comprises a horizontal member having a first end and a second end and a wall depending from the second end. The bearing surface defines an opening or groove therein to receive a portion of the horizontal member, with the depending wall overlying the upper portion of the primary liner means. Prior to the insertion of the member into the groove or opening, sealant is applied thereto.

The present invention also is embodied as a method of relining an existing trench, having a bottom and two vertical walls. To reline an existing trench, thereby creating a dual containment trench, a secondary liner, having an exterior surface and an interior surface, is placed along the length of the trench to provide secondary containment trench. A separating means, having a first surface and an opposed second surface, is placed on the secondary liner means so that the second surface of the separating means is in contact with the interior surface of the secondary liner. Then a primary liner, having an interior surface and an exterior surface, is placed on the separating means so that the exterior surface of the primary liner is in contact with the first surface of the separating means. The primary liner, the secondary liner and the separating means are held against the trench wall. The secondary liner means may be supported in existing rectangular trenches by placing a support member in a portion of the trench, along its length, to support the secondary liner means.

The separating means may be placed so that a gap is formed in the separating means along its length into which fluid leaking out of the primary liner means flows. A fluid sensor may be set in the gap to detect fluids that have leaked into the gap through the primary liner. The gap may also drain into a visual inspection tank to detect leaks in the primary liner.

The trench containment unit is extremely flexible in allowing continuous walls with no joints for two hundred feet or more. The trench containment unit should be an unbroken unit as long as possible to minimize the number of joints which might leak. The primary and secondary walls can be neutral or sloping as needed. Where long trenches occur, there will be expansion of the trench walls beyond the length of the frames. This expansion must be unimpeded but accommodations for added length, turns, and intersections may be added as needed.

To form a place for the new frame, the concrete or other material must be cut behind and under the current trench frame far enough for the new frame to fit and be held securely once the frame is in place. Once accomplished, the frame may be removed from its anchor plates (although it does not have to be). Once removed, the new supporting means and secondary means and the separating means and perforated plate are installed and the primary liner is then placed snugly on top of the separating means. The top of the primary liner, the separating means and the secondary liner means are placed snugly behind the lower part of the frame. Sealants may be used between the frame and the concrete, behind the bolts securing the frame to its base, and between frame sections.

Expansion and contraction will be accommodated by the design of the wall ribs or by the methods used in U.S. Pat. Nos. 5,256,000 and 5,281,052.

It is an object of the present invention to provide an improved dual containment trench.

It is also an object of the present invention to provide a means to renew a trench without replacing it in its entirety.

It is also an object of the present invention to provide a means to convert an existing trench from a single containment system to a dual containment system.

It is also an object of the present invention to provide a means to build a trench by conventional means and at the same time additionally turn it into a dual containment system.

These and other objects will become apparent from the following description of the preferred embodiment taken in conjunction with the following drawings, although variations and modifications may be effected without departing from the spirit and scope of the novel concepts of the disclosure.

DETAILED DESCRIPTION OF THE PREFERRED EMBODIMENTS

Figure 1:
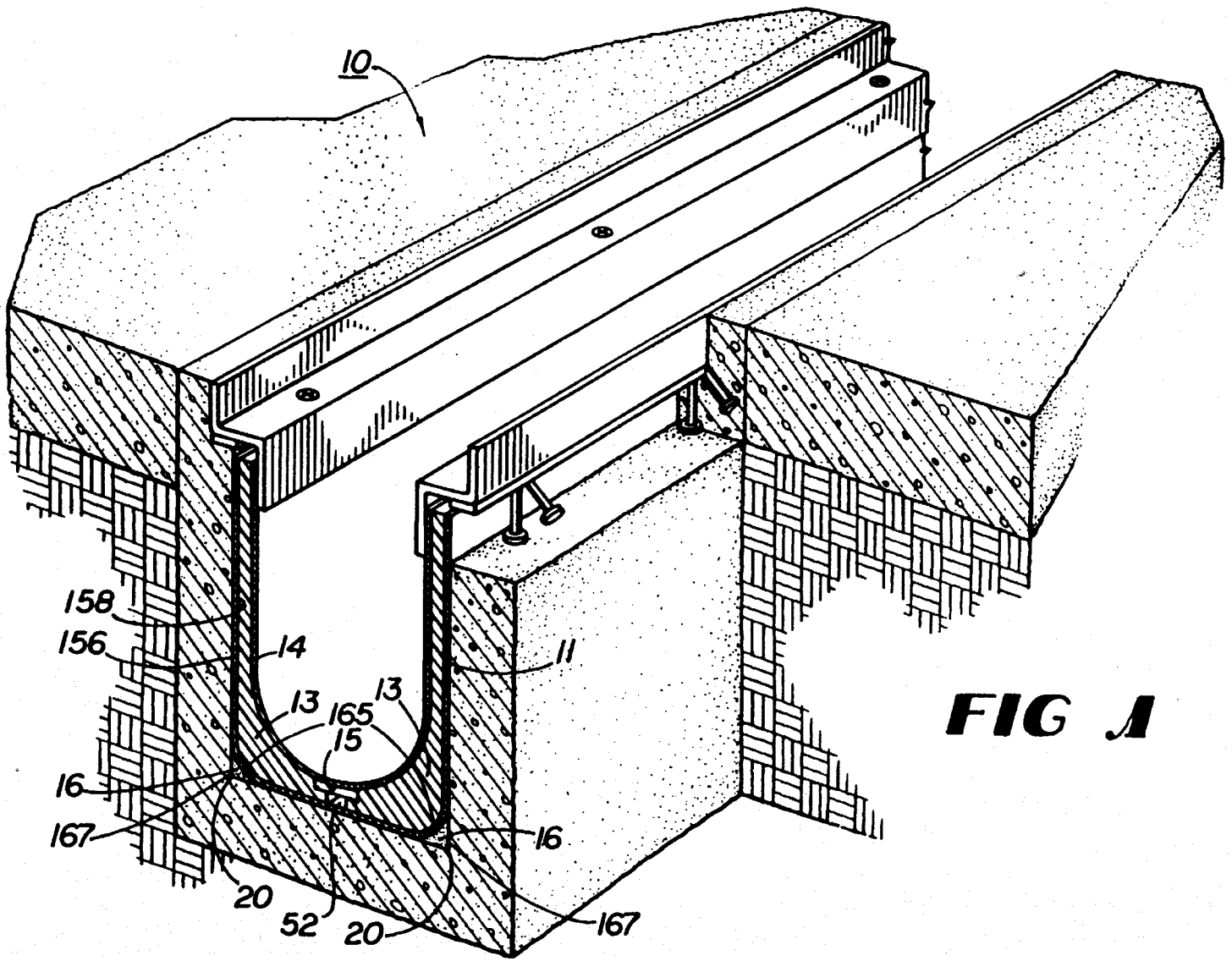
FIG. 1 is a perspective view of a trench assembly of the present invention having a multi-walled rectangular design.

A preferred embodiment of the invention is now described in detail. Referring to the drawings, like numbers indicate like parts throughout the views.

Figure 4:
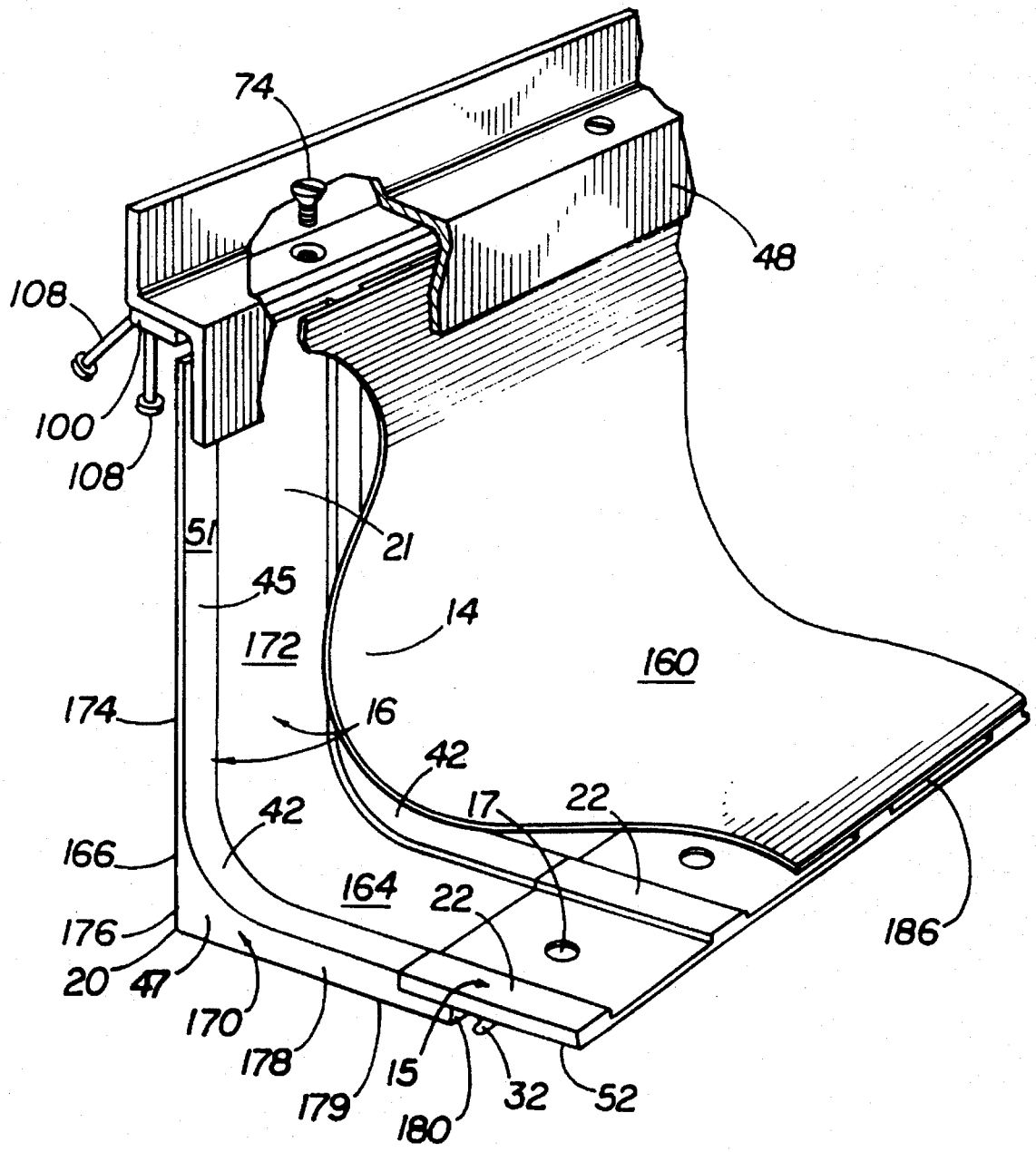
FIG. 4 is a partial cross-sectional and perspective view of the lined trench in accord with the present invention.
Figure 5:
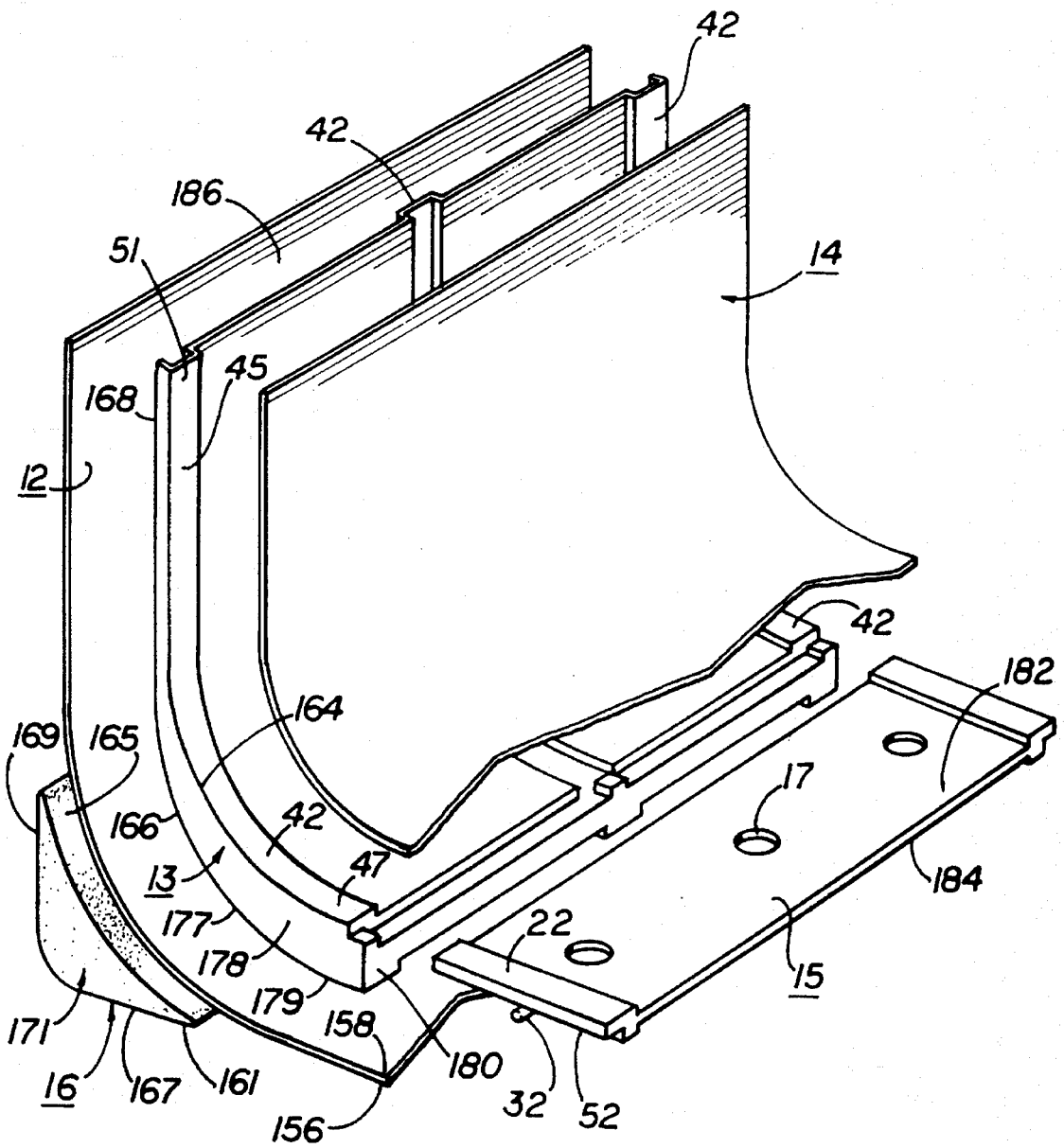
FIG. 5 is a partial cross-sectional and perspective view of the liner parts in accord with the present invention.
Figure 6:
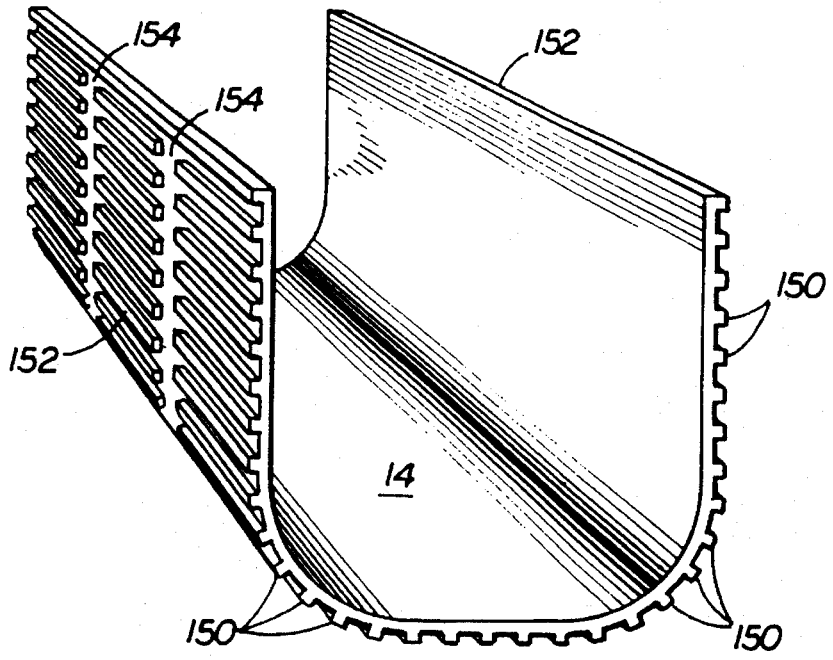
FIG. 6 is a perspective view of a primary wall with a plurality of ribs disposed along its length.

Referring to FIGS. 1 and 5, a preferred embodiment of the present invention 10, a multi-walled trench, is shown. It comprises a supporting means 16 which rests within an existing trench 11 having two opposed vertical walls and a bottom. The supporting means 16 has a first surface 165 open to the interior of the trench and an opposed second surface 167 and it extends along the length of the trench. The present invention 10 also comprises a secondary liner means 12, having an interior surface 158 and an exterior surface 156, disposed along the length of the trench, supported by the supporting means 16. A cavity 186 is defined by the separating means 13 between the secondary liner means 12 and the primary liner means 14. The separating means 13 may comprise (as shown in FIGS. 4 and 5) vertical ribs 42 or (as shown in FIG. 6) horizontal ribs 152.

Figure 3A:
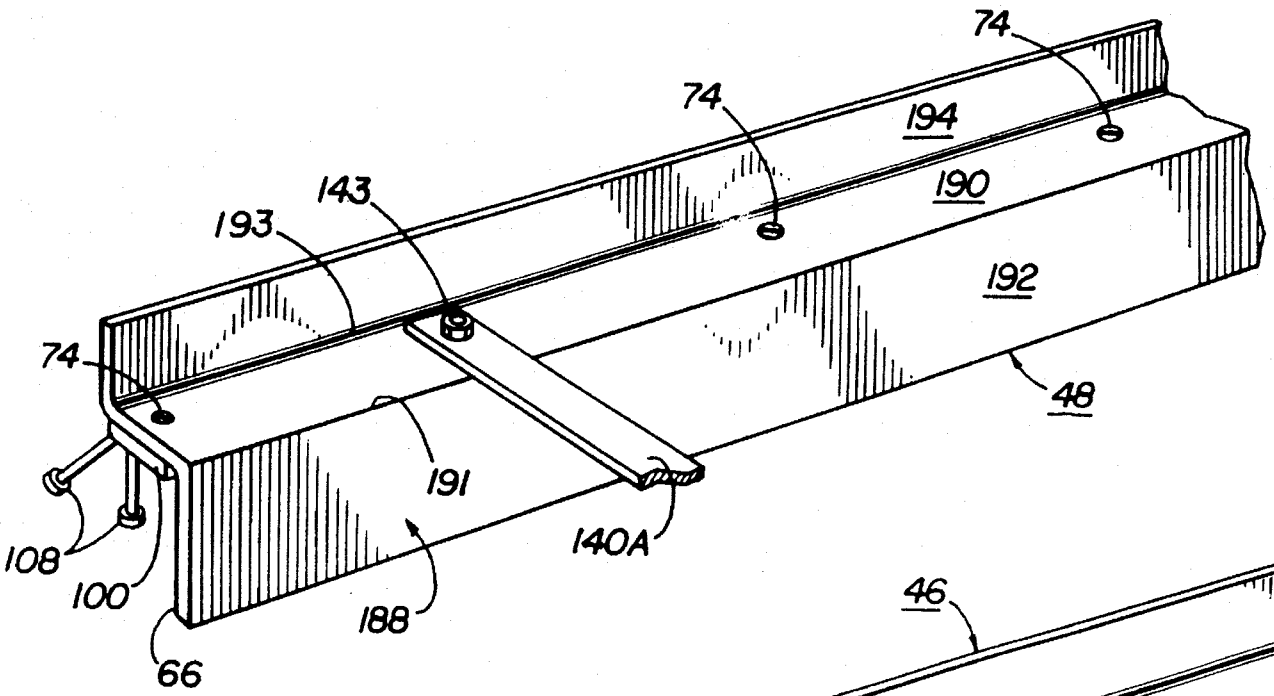
FIG. 3*a–b* are perspective views of the frame member in removable and non-removable configurations.
Figure 3B:
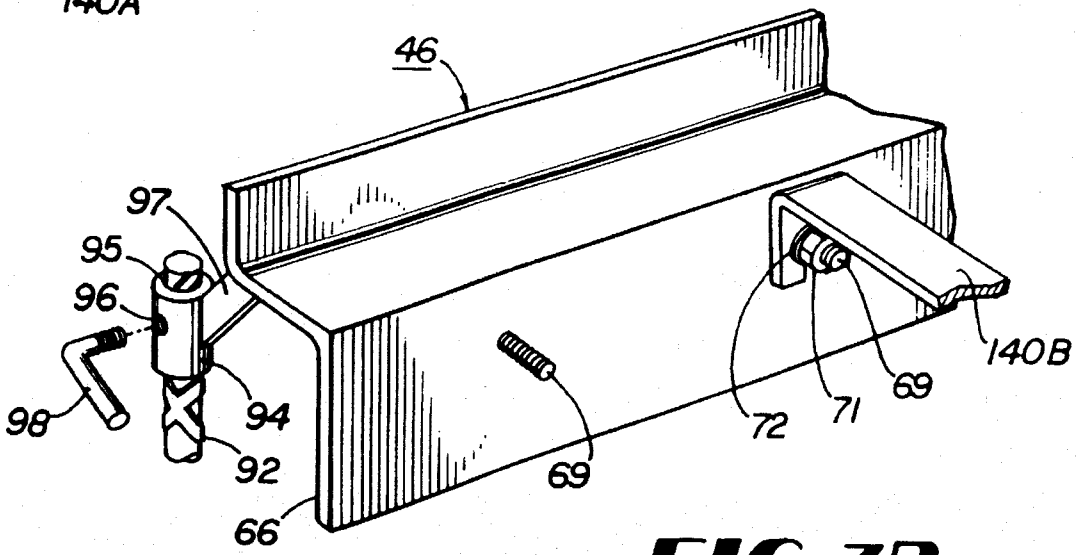

The secondary liner 12 comprises a material (e.g., fiberglass, plastic, stainless steel, coated steel, or any other formable material) that is resistant to the fluids which the trench is designed to hold. The secondary liner 12, the separating means 13, the primary liner 14 and the supporting means 16 are held against the existing trench wall 11 with a means for holding 46 or 48 (as shown in FIGS. 3*a* and 3*b*), the primary liner means 14, the separating means 13, and the secondary means 12 to the trench wall. The primary liner 14 the separating means 13 and the secondary liner means 12 are not attached to the supporting means 16, allowing the primary liner 14, the separating means 13, and the secondary liner means 12 and the support means 16 to expand and contract along their lengths independently from each other.

The separating means 13 separates the primary liner means 14 from the secondary liner means 12, and support means 16, thereby defining a cavity 186 therebetween. This also allows for the easy removal and replacement of the holding means 48, the primary wall 14, the separating means 13, the secondary wall 12 and the supporting means 16. In an alternative embodiment, as shown in FIG. 6, the primary liner 14 has a plurality of fibs 150 disposed horizontally on the external surface 152 of the primary liner 14 along its length. A plurality of openings 154 in the ribs 150 may be placed along their length to allow for downward fluid drainage.

Figure 2:
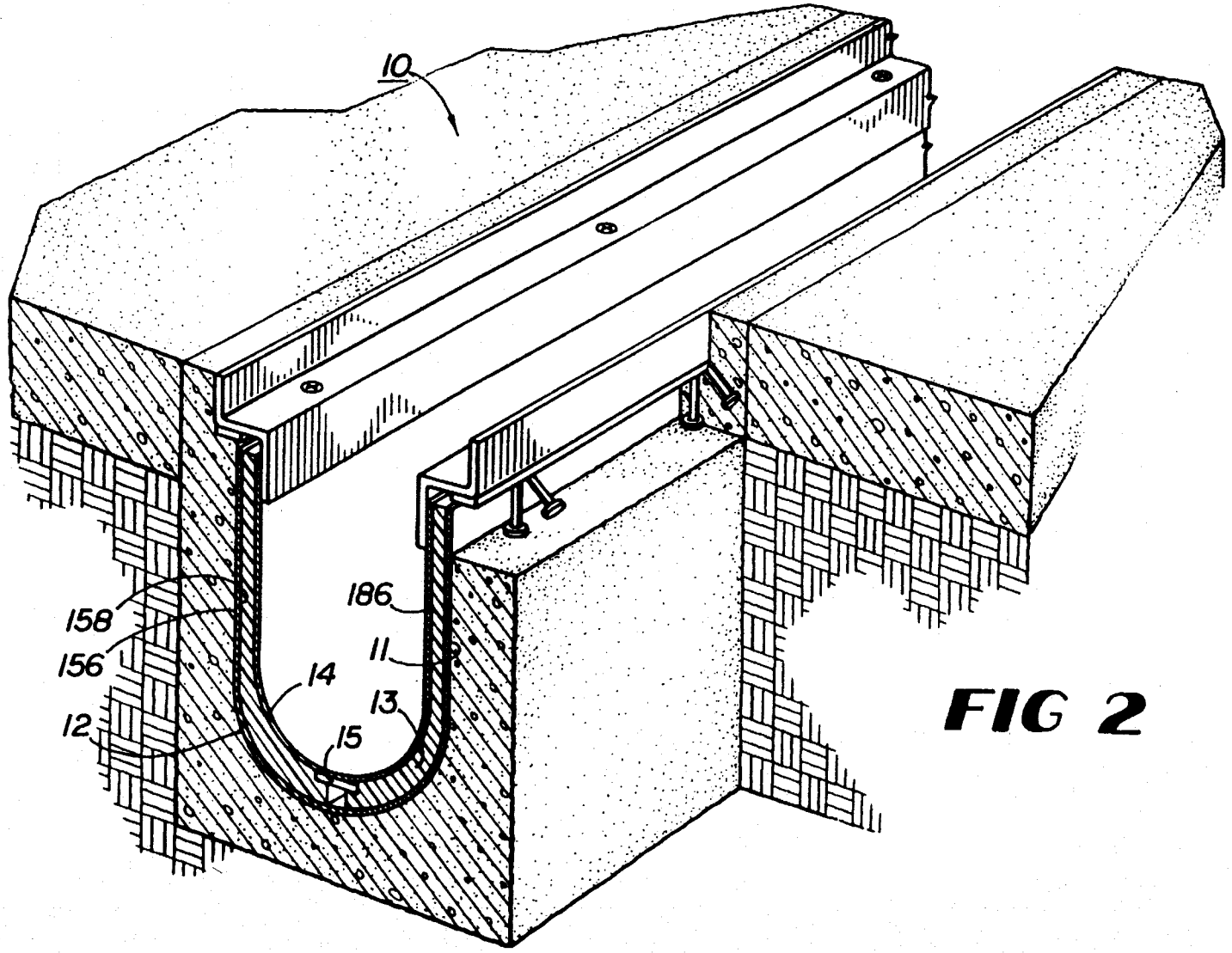
FIG. 2 is a perspective view of a trench assembly of the present invention having a multi-walled curved bottom design.

Referring to FIGS. 2 and 5, in a preferred embodiment of the present invention 10, a multi-walled, curved bottom trench is shown. It comprises a secondary liner means 12 having an interior surface 158 and an exterior surface 156, disposed along the length of the trench. Cavities 186 are defined by the separating means 13 between the secondary liner means 12 and the primary liner means 14. The separating means 13 may comprise (as shown in FIG. 5) vertical ribs 42 or (as shown in FIG. 6) horizontal ribs 152.

The secondary liner 12, the separating means 13 and the primary liner 14 comprise a material (e.g., fiberglass, plastic, stainless steel, coated steel or any other formable material) that is resistant to the fluids which the trench is designed to hold. The secondary liner means 12, the separating means 13, and the primary liner means 14 are held against the existing trench wall 11 with a means for holding 46 or 48 (as shown in FIGS. 3*a* and 3*b*), the primary liner means 14, the separating means 13 and the secondary liner means 12 against the trench wall. The primary liner means 14, the separating means 13 and the secondary liner means 12 are allowed to expand and contract along their lengths independently from each other.

The separating means 13 separates the primary liner means 14 from the secondary liner means 12, thereby defining cavities 186 therebetween. This also allows for the easy removal and replacement of the holding means 48, the primary wall means 14, the separating means 13 and the secondary wall 12. In an alternative embodiment (as shown in FIG. 6) the primary liner 14 has a plurality of ribs 150 disposed horizontally on the exterior surface 152 of the primary liner 14 along its length. A plurality of openings 154 in the ribs 250 may be placed along their length.

Referring to FIGS. 2 and 5, the separating means 13 comprises two opposed elongated members 178 which are substantially parallel and which may comprise a substantially L-Shaped frame structure. The two elongated members 178 run along the length of the trench, one on each side, and in opposed relation to each other. Each elongated member 178 comprises an upright portion 168 having a front surface 164, an opposite rear surface 166, a lower portion 177 having an underside surface 179 horizontally extending to termination in a distal edge 180. Each rib 42 is spaced along the elongated member 178 and includes an upstanding portion 45 which has an upper end 51, and an opposite lower end 47. The width of the elongated member 178 is less than one-half of the width of the trench, therefore a gap 52 is formed between the distal edges 180 which longitudinally extend along the length of the gap 52. A perforated plate 15 having an upper surface 182, a lower surface 184 and a plurality of spacing surfaces 22 is placed in contacting relationship with the distal edges 180 of the opposed elongated members 178. Beneath plate 15 maybe a means 32 for fluid detection within the gap. The fluid detecting means may be an electronic fluid sensor 32, a single point or visual means of detecting fluids that have leaked out of the primary liner means 14 through holes 17 into gap 52.

Referring to FIG. 1 and 5, the support means 16 comprises two opposed elongated members 171 which are substantially parallel and may comprise a substantially L-shaped frame structure. In some embodiments, the shape of the existing trench wall 11 is not necessarily rectangular, therefore, the elongated members 171 must conform to the shape of the trench wall 11. The two elongated members 171 run along the length of the trench, one on each side, in opposed relation to each other. Each elongated member 171 comprises an upright portion 169 and a lower horizontal portion 161 having a front surface 165, and an opposite rear surface 167. The width of the elongated member 171 is less than one-half of the width of the trench.

As shown in FIG. 1 and 5, supporting means 16 is formed of a rigid material such as fiberglass, plastic, stainless steel, coated steel or any other formable material. The basic shape of the supporting means 16 will conform to a trench of the type shown in FIG. 1 into which the supporting means 16 will be placed. In FIG. 1 the trench has a square bottom so the supporting means 16 is fitted in the outside corner 17. The supporting means 16 might have a curved or other shaped rearward side and will be shaped to fit the interior of the trench.

The supporting means 16 may be of varying heights, widths, lengths, and thicknesses. Typically, the supporting means 16 will be molded or formed to a specific size for the trench into which it is to be placed. The supporting means 16 may comprise a plurality of members having relatively short lengths, with space left between each unit member to accommodate any expansion or contraction that might occur.

Figure 7:
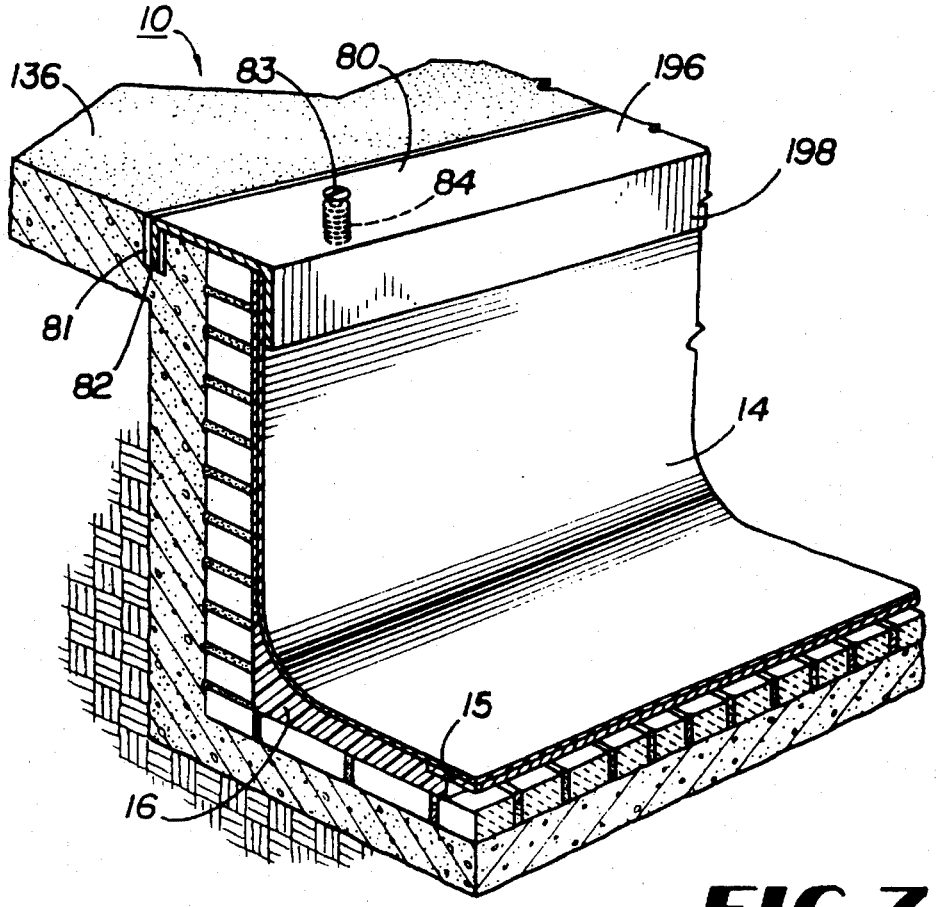
FIG. 7 is a partial perspective view of the trench assembly in which there are no frames, grates or covers.

FIG. 7 shows an embodiment of the trench with no frames, grates or covers within the trench wherein the holding means 80 is substantially U-shaped. It comprises a horizontal member 196 having a first end with a first wall 82 depending therefrom and an opposed second end with a second wall 198 depending therefrom. The top surface 136 of the trench wall has an opening 81 therein to receive a portion of the first depending wall 82 and the second depending wall 196 overlies the upper portion of the primary liner 14, the supporting means 13 and the secondary liner means 12. To reline trench 10 or to turn trench 10 into a dual containment trench, the support means 16 may be installed when needed. The secondary liner means 12, the separating means 13, the primary liner means 14 along with the perforated plate 15 are put in place. U-shaped holding means 80 are fitted against the secondary liner means 12 the separating means 13 and the primary liner 14 in a vertical fashion, leaving each enough room to move independently of one another.

The horizontal portion of the U-shaped holding means 80 is fastened to the surrounding surface with a bolt 83 extending from the surface into an expansion shield 84 holding the U-shaped holding means 80 in place. Sealants may be used in the opening 81 between the adjacent U-shaped holding means 80, the top surface 136, and between the adjacent U-shaped members along the trench. In some instances, it may be necessary to remove material under the U-shaped holding means 80 in order to make the top of the U-shaped holding means 80 level with the surface 136.

FIG. 3 shows two variations of holding means 46, 48 and two variations of connecting members 140A, 140B. As shown in FIG. 3*b*, on holding means 46 the preferred ground anchoring means comprises a supporting rod 92, a cylindrical collar 94 having a threaded bore 96, laterally extending therethrough and a longitudinally extending opening 95 for receiving the supporting rod 92, a bolt 98 which is threaded to match the threaded bore 96, a connecting member 97 attached to the collar 94. That the rod 92, the collar 94, and its axial opening 95 need not be cylindrical in shape. The length of rod 92 will be determined by the maximum length which can be anchored into the cut-out trench opening.

As shown in FIG. 3*a*, holding means 48 shows an anchor member 100 which has a planar portion 190 and is affixed to the upper portion of an existing trench wall (not shown) by leg members 108 or anchor stands 92, 95, 96, 97, and 98. A frame 188, removably attached to the anchor member 100, may be removably attached to the anchor member 100 with a bolt 74 or other attaching means. Frame 188 is Z-shaped with a horizontal portion 190 having a first side 191 and a second opposing sides 193. The first side 191 terminates in a depending portion 192 and the second side 193 terminates in an upright portion 194. The horizontal section 190 overlies the anchor member 100 and depending portion 192 overlies the upper portion of the primary liner 14 and the supporting means 16. A slotted spacer bar 140*a* which is held to the frame 188 with bolts, nuts, or threaded bores for receiving a bolt therethrough may be used to keep the opposing holding means 48 parallel one to another. FIG. 3*a* shows holding means 48. However, holding means 46 (as shown in FIG. 3*b*) could also be used.

Figure 9A:
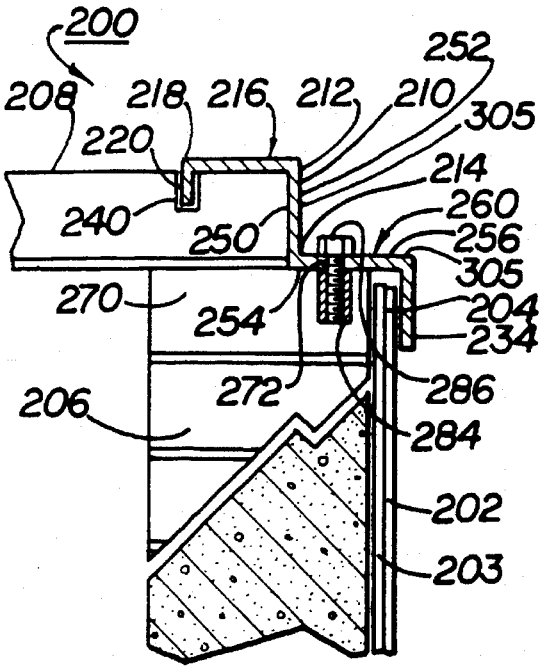
FIG. 9A–9D are cross-sectional views of several alternative embodiments of the holding means.
Figure 9D:
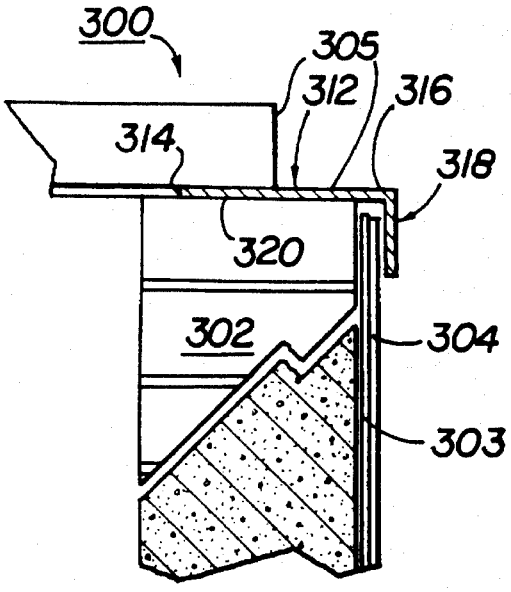
Figure 9B:
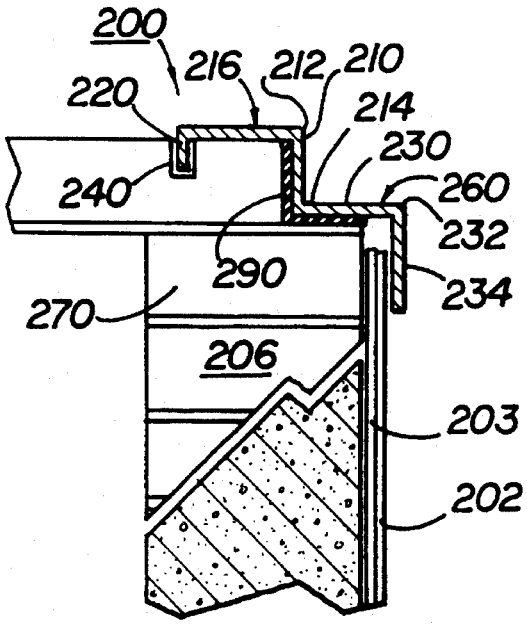
Figure 9C:
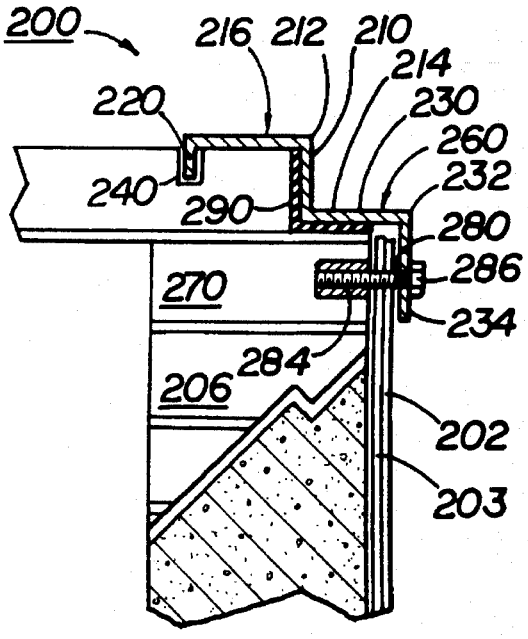

As shown in FIGS. 9A–9C, another alternative preferred embodiment of the holding means 200 comprises a vertical member 210 having an upper end 212 and an opposite lower end 214, a first horizontal member 216 extending from the upper end 212 and terminating in a first edge 218. A first wall 220 depends from the first edge 218. A second horizontal member 230 extends outwardly from the lower end 214 and terminates in a second edge 232 having a second wall 234 depending therefrom. The top surface 208 of the trench may have a channel 240 therein to receive a portion of the first depending wall 220, with the second depending wall 234 overlying and maintaining in place the upper portion 204 of the primary liner means 202 and/or the secondary liner 203.

The vertical member 210 has an inner surface 250 and an opposite outer surface 252. The second horizontal member 230 has a lower surface 254 and an opposite upper surface 256. The outer surface 252 of the vertical member 210 and the upper surface 256 of the second horizontal member 230 form a ledge 260 on the bearing surface adapted to receive a respective bearing surface of a trench grate or cover (not shown).

Several methods may be employed to secure the holding means 200 to the trench wall 206. In one, as shown in FIG. 9A, the second horizontal member 230 defines a first opening 272 therethrough and the bearing surface defines a second opening 284 in registry with the first opening 272 and adapted to receive a bolt 286 passing therethrough, thereby securing the holding means 200 to the trench wall 206. An alternative method of securing the holding means 200 to the trench wall 206, is shown in FIG. 9C, wherein the second wall 232 of the holding means 200 defines a first opening 280 therethrough and a portion of the trench wall 270 defines a second opening 284 adapted to receive a bolt 286 passing through the first opening 280. In another alternative method of securing the holding means 200, as shown in FIG. 9B, the holding means 200 is secured to the bearing surface 305 with a sealant 290, such as polysulfide sealant Morton International No. 2282. Similarly, cement or grout may be used to secure the holding means to the existing trench wall.

In another alternative preferred embodiment, as shown in FIG. 9D, the holding means 300 comprises a horizontal member 312 having a first end 314 and an opposite second end 316, which terminates in a depending wall 318 with a sealant maintaining the holding means 300 in place. The bearing surface 305 defines a horizontal channel therein to receive the first end 314 and a portion of the horizontal member 312. The depending wall 318 overlies and holds in place the upper portion of the primary liner means 304 or secondary liner means 303 against the trench wall 302.

As shown in FIG. 5, ribs 42 are placed on the separating means 13 in a vertical orientation to define a rectangular cavity 186 between the separating means 13 and the primary liner 14 so that a break in primary liner 14 would allow fluids to migrate from the break, down the cavity 186 through holes 17 in the perforated plate 15 to the bottom of the trench and to a sensing system such as in electronic fluid sensor 32. However, in FIG. 6, horizontal, rather than vertical, ribs with breaks close to each other, would also allow migration of a leak to the sensor. The actual shape of the ribs could be rectangular, square, rounded or any other applicable shape, as would be obvious to one skilled in the art.

The thickness of ribs 42 and their distance apart is determined by the materials from which the primary liner 14, the secondary liner 12, the separating means 13 and the supporting means 16 are made. With many materials, significant expansion and contraction occurs as fluids pass through the trench at varying temperatures. Expansion and contraction also occurs when there are no fluids in the trench at all. It is important to maintain a space between the primary liner 14 and secondary means 12 when expansion or contraction occur. This is particularly important for the primary liner means 14. By properly spacing ribs of the proper thickness and shape, expansion of the material in the primary liner means 14 and secondary liner means 12 will occur between the ribs in a rippling or "S" shaped or cupping way, minimizing the effects of the expansion in the overall trench. This is especially important with long trenches, some of which could be hundreds of feet long.

Because trenches vary in width, perforated plate 15 was designed with spacing surfaces 22 of the same width, depth, shape and spacing as the separating means 13. The width of the perforated plate 15 is determined by the width of the trench and the width of the elongated members 178. Between spacing surfaces 22 is a plurality of holes 17 through which any fluids may flow, particularly in the case of a puncture of the primary liner means 14. Any fluids so flowing may be detected by a fluid sensor 32 for leak detection. Spacing surfaces 22 on the perforated plate 15 are aligned with ribs 42 on supporting means 13.

Figure 8:
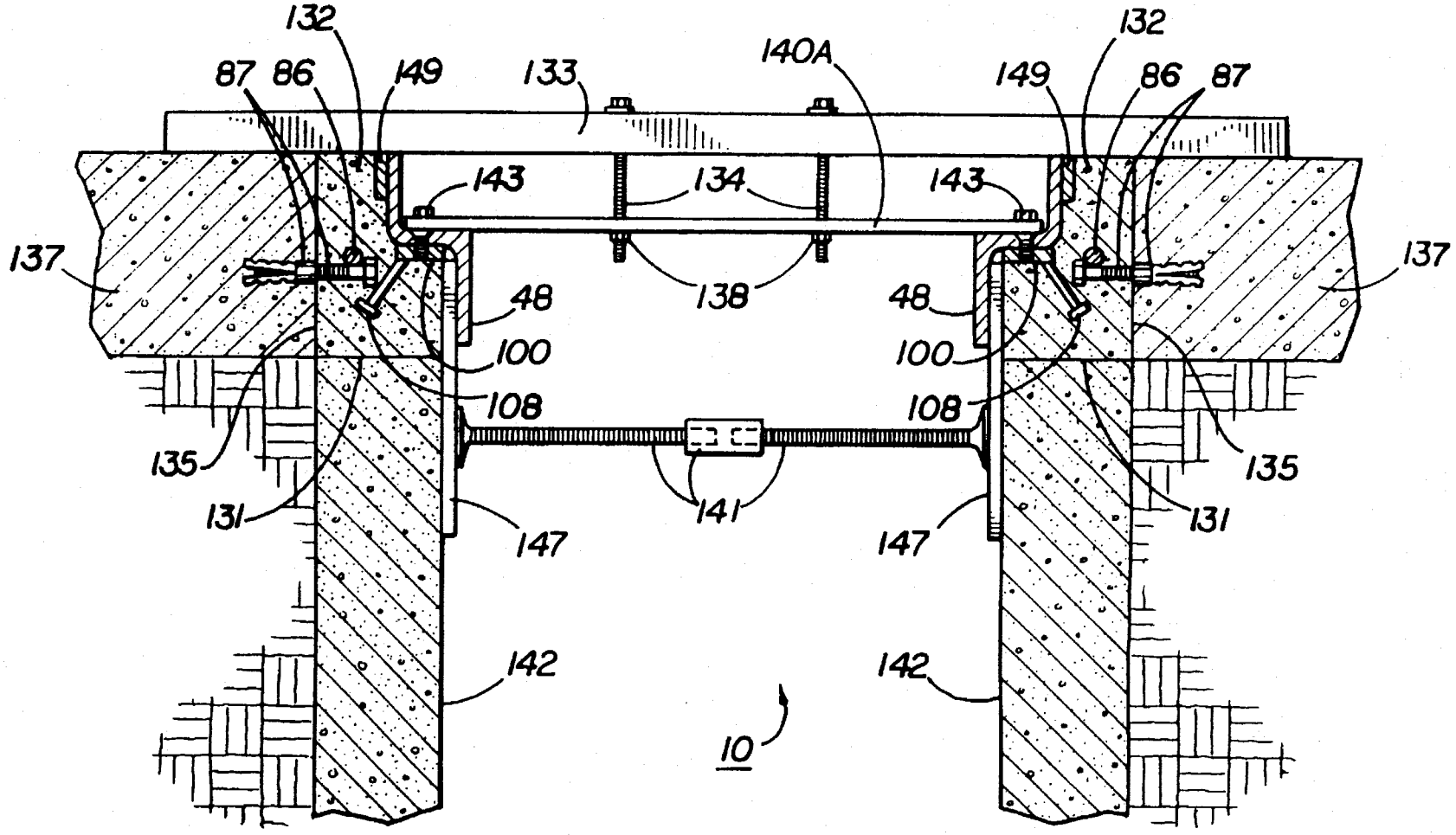
FIG. 8 is a cross-sectional view of a means to hold the frame assembly in position when pouring concrete or other material about it.

FIG. 8 illustrates a method of frame installation prior to relining a trench or the conversion of a trench to dual containment. It is preferred to place two or more crossing members 133, which can be pieces of hanger material, such as wooden 4×4's or steel channels, across the trench for each frame member. The frames 48 are suspended from these trench crossing members 133. The spacer bars **140*a* or 140*b*, using wire or nuts 138 and bolts 134, hold the frames at the proper finished elevation. A block 147 slightly thicker than primary liner 14, the separating means 13, and the secondary liner means 12 and made of solid material is placed between the holding means 48 and the existing wall 142, and held firmly by spreaders 141 placed along the trench as needed. Expansion bolts 87 are attached to the existing concrete 137 at regular intervals along the vertical wall 135. Attached to the anchor bolts 87 is a reinforcing rod 86, preferably lying in a horizontal manner and attached firmly to the expansion bolts 87. Grout, or other material, is filled into notch 132 behind and below the holding means 48. As the material hardens, a groove 149** is formed behind the frame into which a sealant is later placed.

Once the filled material in the notch 132 has sufficiently hardened, the spreaders 141, the blocks 147, the crossing members 133 and the hangers 134 are removed, the spreader bars **140*a* or 140*b* are removed, and sections of the new material in the notch 132** are coated on the new top and face with a sealant that will withstand the fluid that will pass through the trench, if required.

INSTALLATION AND OPERATION

Referring to FIG. 8, the installation and the operation of the multi-walled trench system 10 is as follows: In a retrofit of a worn-out trench or in the assembling of a dual containment trench within a working trench, the installation process remains the same. A vertical cut 135 in the concrete, bricks, or other existing material is made deep enough and far enough from the face of the existing trench 11 to remove the old frame and to hold the replacement frame assembly 48 and the primary liner 14, the separating means 13 the secondary liner 12 and the supporting means 16, if needed. A horizontal cut 131 is made deep enough to meet the vertical cut 135 until the old frame assembly can be removed, thus forming a notch 132 in the existing trench wall 11. The new frame assemblies 48 are secured to each other by spreader bars **140*a* or 140*b*, held to the frames by bolts 143 or by nuts and bolts 69, 71. Bars made of strong pieces of wood such as 4×4's, steel channels or angle irons 133 are placed across the trench past the notch 132. The frame is centered over the trench 10 and securely attached by bolts 134 and nuts 135, or wired securely, to crossing member 133 across the trench so that the top of the frame 48 fits snugly against the crossing members 133. A block 147 is placed between the frame and the existing wall 142, held firmly by a spreader 141. The block is slightly thicker than the thickness of the primary liner 14, the separating means 13 and the secondary liner 12 so as to provide enough room for the primary liner 14 separating means 13 secondary liner 12 and support member 16 to move independently of each other during expansion or contraction and deep enough to more than cover the face of the notch 132. Grout or other material is filled into notch 132 behind and below frame assemblies 48. As the material hardens, a groove is formed behind the frame into which sealant is later placed. Once the filled material has sufficiently hardened, the spreaders 140***a*, 140*b* are removed, the crossing members 133 are removed, and notch 132 is coated on the new top and face with a sealant that will withstand the fluid that will pass through the trench, if required. The same general method is used with frame 46, as shown in FIG. 3*a*.

The frames 48 are removed from anchor members 100, if used, and placed adjacent to the removal area. Supporting means 16, if needed, are put in place within the trench on both sides, secondary liner 12 is placed against support means 16 and up the trench wall. The separating means 13 are placed within the secondary liner 12, perforated plate 15 is put in place and the primary liner 14 is placed inside the separating means 13 so that the walls of each are in engagement with each other. The frame 48 is put in place on the anchor member 100 with the supporting means 16, the secondary liner 12, the separating means 13 and the primary liner 14 behind the frame. When all frames are in place, a sealant, such as a polysulfide, is used to fill the groove 149 behind the frame and in the space between frames abutting each other and under the bolts 74 used to fasten the frame 48 to its anchoring member 100.

Where frame 46 is used, it can not be removed after it is set in place as with frame 48. Instead the supporting means 16, if needed, is placed in both bottom corners of the trench. The secondary liner 12, the separating means 13 and the perforated plate 15 are placed between, and aligned with, the elongated members 170. The primary liner 14 is pushed up from underneath frames 46 until in place on both sides of the trench against side 142 (as shown in FIG. 8). Grates or covers may then be placed in the frames with the trench system then ready for use.

The above embodiments are given as illustrative examples and are not intended to impose any limitations on the invention. It will be readily appreciated that many deviations may be made from the specific embodiments disclosed in this specification without departing from the invention. Accordingly it is intended to cover all such modifications as within the scope of this invention.

What is claimed is:

1. A trench liner system for forming a dual containment trench and for relining an existing trench having at least two walls, a bottom surface, a top surface, and a bearing surface comprising:

a. secondary liner means, with an interior surface and an exterior surface, extending along the length of the trench;

b. primary liner means, having an interior surface and an exterior surface, disposed within the trench within the secondary liner means and extending along the length of the trench;

c. means disposed between the secondary liner means and the primary liner means for separating the interior surface of the secondary liner means from the exterior surface of the primary liner means; and d. means for holding at least the primary liner means against the trench walls wherein the holding means is directly and fixedly secured to at least one of the walls, the top surface or the bearing surface.

2. The system of claim 1, wherein the interior surface of the primary liner means has an upper portion and wherein the holding means comprises a vertical member having an upper end and an opposite lower end, a first horizontal member extending from the upper end and terminating in a first edge having a first wall depending therefrom, and a second horizontal member extending from the lower end away from the first horizontal member, the second horizontal member terminating in a second edge having a second wall depending therefrom, the top surface of the trench wall defining a vertical channel therein to receive a portion of the first depending wall, the second depending wall overlying the upper portion of the primary liner means.

3. The system of claim 2, wherein the vertical member has an inner surface and an opposite outer surface, the second horizontal member has a lower surface and an opposite upper surface, the outer surface of the vertical member and the upper surface of the second horizontal member forming a ledge for receiving thereon the beating surfaces of grates or covers.

4. The system of claim 3, wherein the second horizontal member defines a first opening passing therethrough and the bearing surface defines a second opening in registry with the first opening and adapted to receive a bolt passing through the first opening, thereby securing the holding means to the trench wall.

5. The system of claim 3, wherein the second wall defines a first opening passing therethrough and a portion of the trench wall defines a second opening in registry with the first opening and adapted to receive a bolt passing through the first opening, thereby securing the holding means to the trench wall.

6. The system of claim 1, wherein the interior surface of the primary liner means has an upper portion and wherein the holding means comprises a horizontal member having a first end and a second end and a wall depending from the second end, the bearing surface defining a horizontal channel therein to receive a portion of the horizontal member, the depending wall overlying the upper portion of at least the primary liner means.

7. The system of claim 1, wherein the holding means is adhered to the bearing surface with a sealant.

8. The system of claim 1, wherein the holding means is adhered to the bearing surface with cement or grout.

* * * * *